US011035588B2

(12) United States Patent
Choi

(10) Patent No.: US 11,035,588 B2
(45) Date of Patent: Jun. 15, 2021

(54) BOILER WITH HEATING BLOWER

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 137 days.

(21) Appl. No.: 16/396,310

(22) Filed: Apr. 26, 2019

(65) Prior Publication Data

US 2019/0249899 A1 Aug. 15, 2019

Related U.S. Application Data

(63) Continuation of application No. PCT/KR2018/009733, filed on Aug. 23, 2018.

(30) Foreign Application Priority Data

Oct. 16, 2017 (KR) ..... 10-2017-0133715

(51) Int. Cl.

| | |
|---|---|
| ***F24H 8/00*** | (2006.01) |
| ***F24H 1/44*** | (2006.01) |
| ***F24H 1/28*** | (2006.01) |
| ***F22B 33/08*** | (2006.01) |
| ***F22B 7/14*** | (2006.01) |
| ***F24H 1/36*** | (2006.01) |
| ***F24H 9/00*** | (2006.01) |
| ***F24H 3/04*** | (2006.01) |
| ***F24H 6/00*** | (2006.01) |

(52) U.S. Cl.

CPC ..... *F24H 1/44* (2013.01); *F22B 7/14* (2013.01); *F22B 33/08* (2013.01); *F24H 1/28* (2013.01); *F24H 1/36* (2013.01); *F24H 3/0488* (2013.01); *F24H 6/00* (2013.01); *F24H 9/0031* (2013.01)

(58) Field of Classification Search

CPC ..... F24H 1/145; F24H 9/146; F24H 9/148; F24H 8/00; F22B 21/00; F22B 21/04; F22B 21/081

See application file for complete search history.

(56) References Cited

U.S. PATENT DOCUMENTS 6,044,803 A * 4/2000 Hamos et al.
2019/0041092 A1* 2/2019 Niu et al.

FOREIGN PATENT DOCUMENTS

| | | | |
|---|---|---|---|
| KR | 100217265 | B1 | 9/1999 |
| KR | 100881780 | B1 | 2/2009 |
| KR | 101189791 | B1 | 10/2012 |
| KR | 101609170 | B1 | 4/2016 |

* cited by examiner

*Primary Examiner* — Gregory A Wilson
(74) *Attorney, Agent, or Firm* — Studebaker & Brackett PC

(57) ABSTRACT

The present invention relates to a boiler with a heating blower, the boiler being able to improve heat exchange efficiency without an additional boiler. According to the present invention, there is provided a heating blower that supplies high-temperature hot wind to a flame guide tube outside a storage tub, so it is possible to improve heat exchange efficiency of the flame guide tube and flue tube without an additional boiler.

8 Claims, 10 Drawing Sheets

-- Prior Art --

-- Prior Art --

-- Prior Art --

BOILER WITH HEATING BLOWER

CROSS REFERENCE TO RELATED APPLICATION

The present application is a Continuation of International Application No. PCT/KR2018/009733 filed on Aug. 23, 2018, which claims priority to Korean Patent Application No. 10-2017-0133715 filed on Oct. 16, 2017. The entire contents of which is incorporated herein for all purposes by this reference.

TECHNICAL FIELD

The present invention relates to a boiler with a heating blower and, more particularly, to a boiler with a heating blower, the boiler being able to improve heat exchange efficiency without additional burner.

BACKGROUND ART

In general, industrial boilers have large capacity and high thermal efficiency, so they are widely used in industry for a factory, heating of large building or central heating type apartments, and public baths. High-temperature vapor or hot water should be supplied in large quantity to central heating facilities of large buildings or apartment complexes or industrial facilities such as a factory, so a high-capacity high-efficiency industrial boiler is required in this case.

FIG. 1 is a cross-sectional view of a boiler of the related art. Referring to FIG. 1, a boiler of the related art includes: a body 10 having a water chamber 10*a* therein; a general flue tube 16 disposed in the body 10; a burner 30 having a first side disposed on a side of the body 10 and a second side disposed in the flue tube 16 to generate a flame in the flue tube 16; a plurality of smoke tubes 20 disposed outside the flue tube 16 and communicating with the flue tube 16; and an exit 22 coupled to second ends of the smoke tube 20. An inlet 12 through which water flows inside and an outlet 114 through which water is discharged are formed on a first side and a second side, respectively, of the body 10.

According to this boiler of the related art, as the flue tube 16 is increased in temperature by a flame generated from the burner 30, primary heat exchange occurs between the flue tube 16 and water in the water chamber 10*a*. Further, as combustion gas produced from the flame flows through the smoke tubes 20, the smoke tubes 20 are heated and secondary heat exchange with the water in the water chamber 10*a* occurs. The water heated by exchanging heat with the flue tube 16 and the smoke tubes 20 is supplied to a hot water demander outside through the outlet 114.

It is required to install more burners and increase the sizes of the flue tube and the smoke tubes, but this increases the entire volume, so there is a need for a separate installation space.

DISCLOSURE

Technical Problem

The present invention has been made in an effort to solve the problems of the related art and an object of the present invention is to provide a boiler with a heating blower to be able improve heat exchange efficiency without an additional burner.

Technical Solution

In order to achieve the objects, the present invention provides a boiler with a heating blower, the boiler including:

a housing including a storage tub storing water therein, a first space formed at a first end of the storage tub, a first barrier insulating the storage tub and the first space, a second space formed at a second end of the storage tub, a second barrier insulating the storage tub and the second space, and an inlet and an outlet formed on both sides of the storage tub; a burner unit including a flame guide tube elongated in the storage tub, with a first end connected with the first space through the first barrier and a second end connected with the second space through the second barrier, and a burner disposed in the flame guide tube; a plurality of flue tubes disposed between an inner surface of the storage tub and the flame guide tube, with an end connected with the first space through the first barrier and a second end connected with the second space through the second barrier; and a heating blower having a first end mounted on the storage tub and a second end passing through the storage tub, and generating hot wind toward the flame guide tube, in which a flame generated by the burner moves toward the first end of the flame tube and is then supplied to the flue tubes through the first space, and hot wind generated by the heating blower moves to the flame guide tube and is then supplied to the flue tubes through the first space.

A plurality of heating blowers may be arranged in parallel in a longitudinal direction of the storage tub.

A mounting hole may be formed through an outer surface of the storage tub and an intake hole is formed at a position of the flame guide tube which corresponds to the mounting hole, the flue tubes may be disposed between the inner surface of the storage tub and the flame guide tube without overlapping the mounting hole and the intake hole, and the heating blower may include: an external tube connecting the mounting hole and the intake hole to each other; an external extension covering an end connected with the mounting hole of the external tube; and a heating blower assembly generating hot wind to the external tube through the external extension.

A mounting hole may be formed through an outer surface of the storage tub and an intake hole is formed at a position of the flame guide tube which corresponds to the mounting hole, the flue tubes may be disposed between the storage tub and the flame guide tube without overlapping the mounting hole and the intake hole, and the heating blower may include: an external tube connecting the mounting hole and the intake hole to each other; an external extension covering an end connected with the mounting hole of the external tube; an internal tube having a diameter smaller than the external tube and accommodated in the external tube; a dead-end closing a first end, which faces the flame guide tube, of the internal tube; and a heating blower assembly generating hot wind to the internal tube through the external extension.

The boiler may further include: an internal extension extending along an outer surface of a second end of the internal tube spaced apart from the external extension to be connected to an inner surface of the external tube, and having a plurality of through-holes; and heat tubes extending respectively in the through-holes toward the intake hole, in which hot air discharged toward the internal tube from the heating blower assembly primarily turns toward the external extension after hitting against the dead-end, secondarily turns toward the heat tubes after hitting against the external extension, and then flows into the flame guide tube through the heat tubes and the intake hole.

The heating blower assembly may include: a coupler coupled to a coupling hole formed in the external extension to face the internal tube; a protrusive tube protruding toward the internal tube from a first side facing the internal tube of the coupler; and a hot wind supplier supplying hot wind from a second side of the coupler to the protrusive tube.

The boiler may include first heat exchange fins protruding perpendicular to an imaginary center line passing through a center of an inner surface of the flue tube on a first side of the inner surface of the flue tube from the center line, and second heat exchange fins protruding perpendicular to the center line on a second side of the inner surface of the flue tube to face the first heat exchange fins, in which a plurality of first convex portions and first concave portions may be alternately arranged on longitudinal first sides of the first heat exchange fins and the second heat exchange fins and a plurality of second convex portions and second concave portions may be alternately arranged on longitudinal second sides of the first heat exchange fins and the second heat exchange fins such that the first convex portions and the second concave portions are arranged to face each other and the first concave portions and the second convex portions are arranged to face each other, and a gap between the first convex portions and the second concave portions and a gap between the first concave portions and the second convex portions may be the same.

The first heat exchange fins and the second heat exchange fins that face each other may be spaced apart from each other, and a pair of adjacent first heat exchange fins may be the same or different in length.

Advantageous Effects

According to the present invention, there is provided a heating blower that supplies high-temperature hot wind to a flame guide tube outside a storage tub, so it is possible to improve heat exchange efficiency of the flame guide tube and flue tube without an additional boiler. Further, the heating blower does not occupy a large volume, so there is no need for a large installation space.

Further, since the water stored in the storage tub exchanges heat with the external tube of the flame guide tube, heat exchange efficiency is improved.

Further, since hot wind discharged from the heating blower assembly turns several times while traveling through the internal tube and the external tube, and then flows into the flame guide tube, the hot wind remains longer in the internal tube and the external tube, thereby heating the internal tube and the external tube more. Accordingly, the water of the storage tub that comes in direct contact with the external tube is improved in efficiency of heat exchange with the external tube, so the entire heat exchange efficiency is improved.

Further, the first and second heat exchange fins of the flue tube have uniform widths, so heat exchange efficiency of the first and second fins is increased.

Figure 1:
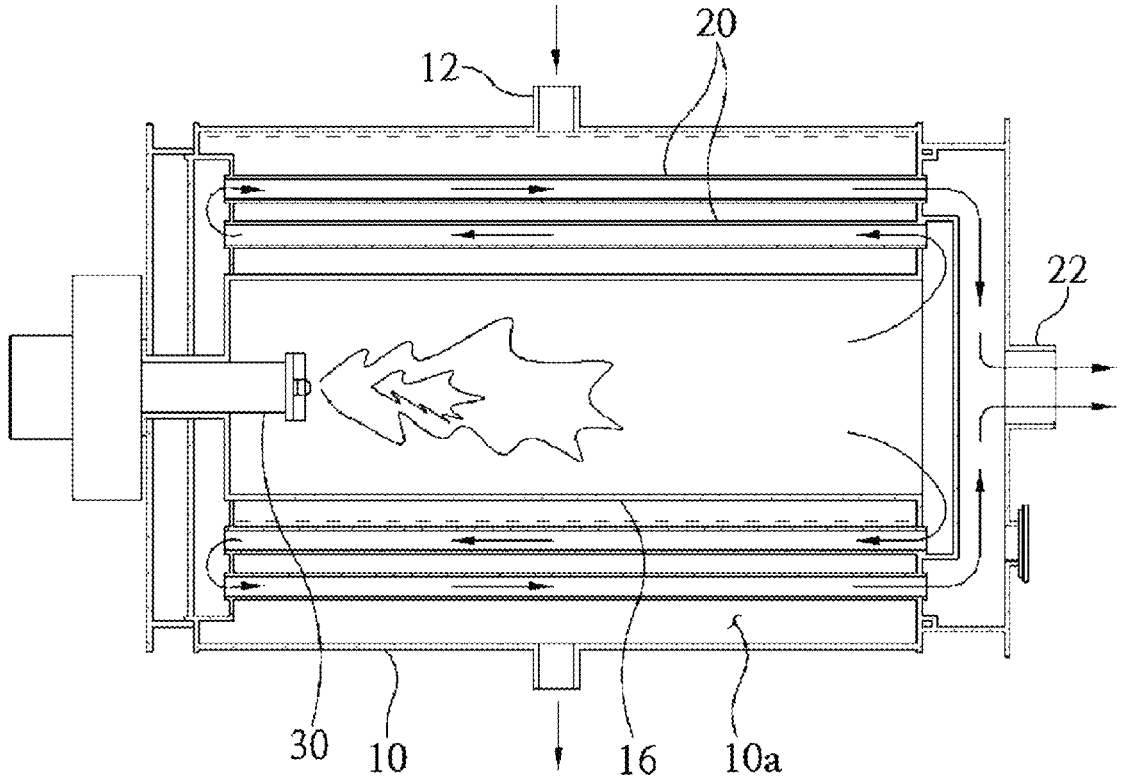
FIG. 1 is a cross-sectional view of a boiler of the related art.

<Description of the Reference Numerals in the Drawings>

| | |
|---|---|
| 50, 52: boiler | |
| 100: housing | 110: storage tub |
| 110a: mounting hole | 112: inlet |
| 114: outlet | 120: first space |
| 122: first barrier | 130: second space |
| 132: second barrier | 140: discharge unit |
| 140a: discharge space | 142: discharge hole |
| 200: burner unit | 210: flame guide tube |
| 212: intake hole | 220: burner |
| 300: flue tube | L: center line |
| 310: first heat exchange fin | |
| 320: second heat exchange fin | |
| 330: first convex portion | |
| 332: first concave portion | |
| 334: first concave portion | |
| 336: second convex portion | |
| 400: heating blower | 410: external tube |
| 412: external extension | |
| 420: heating blower assembly | 422: coupler |
| 424: protrusive tube | 426: hot wind supplier |
| 450: heating blower | 460: external tube |
| 462: external extension | 464: coupling hole |
| 470: internal tube | 472: dead-end |
| 474: internal extension | 474a: through-hole |
| 480: heat tube | 490: heating blower assembly |
| 492: coupler | 494: protrusive tube |
| 496: hot wind suppiler | |

BEST MODE

Hereinafter, boilers with a heating blower according to exemplary embodiments of the present invention are described in detail with reference to the accompanying drawings.

Figure 2:
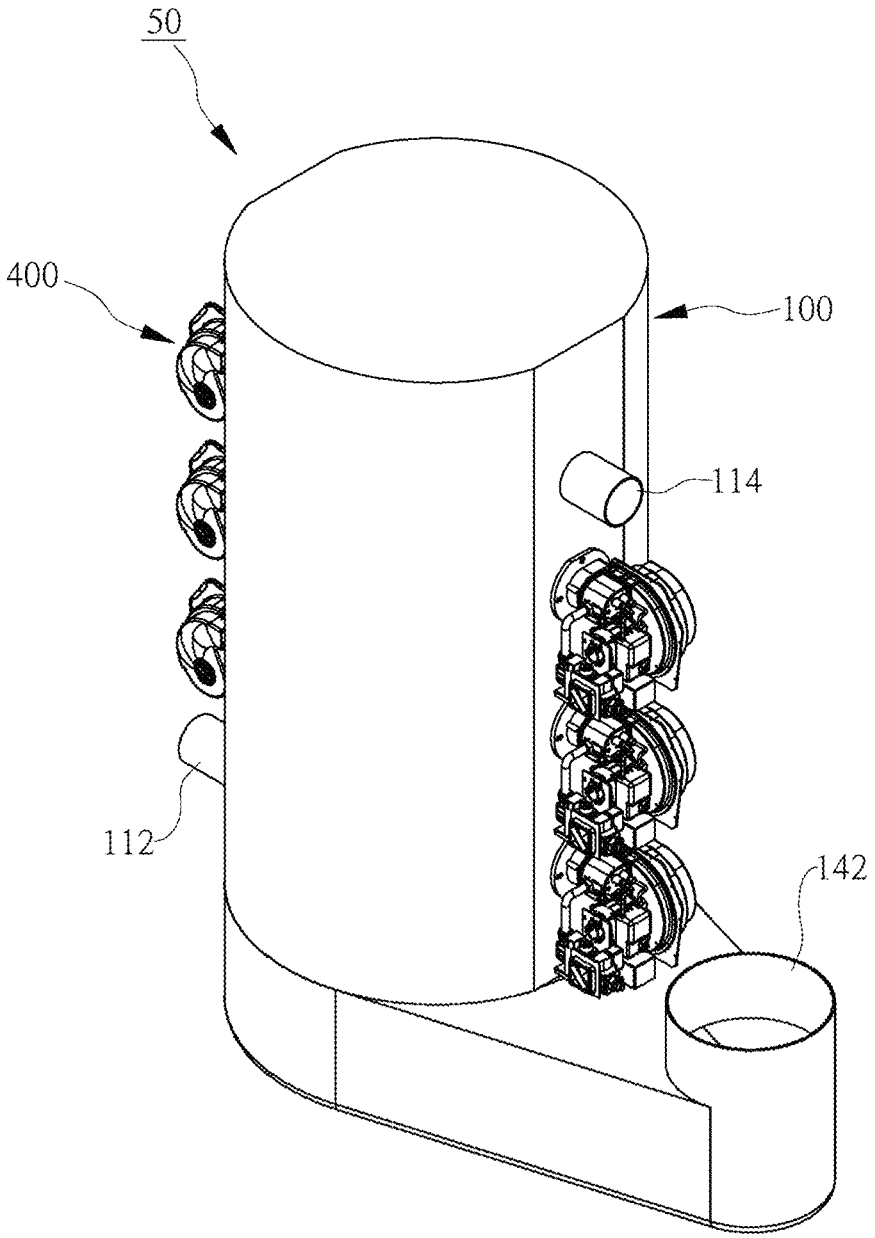
FIG. 2 is a view schematically showing a boiler with a heating blower according to a first embodiment of the present invention.
Figure 3:
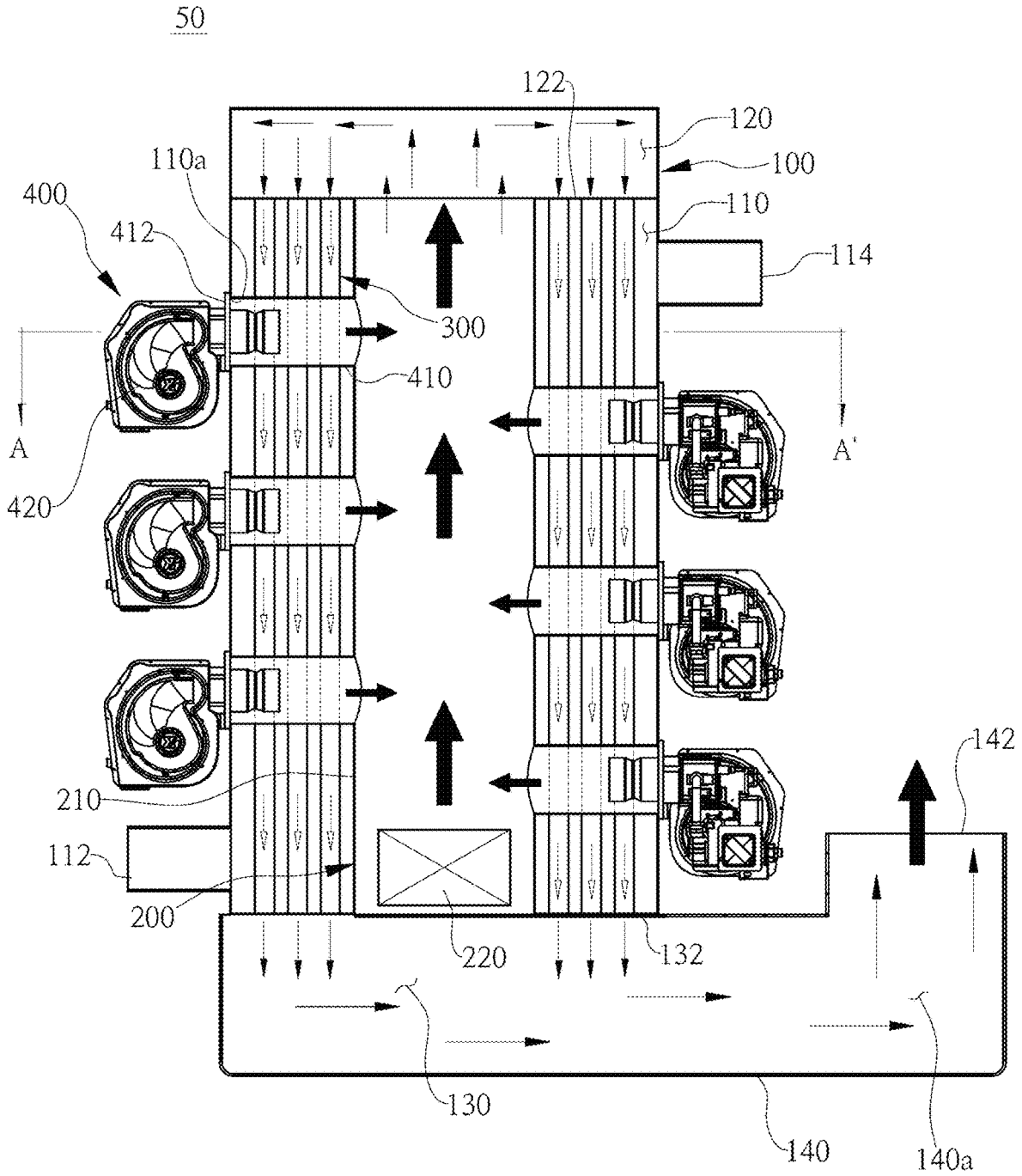
FIG. 3 is a view schematically showing the inside of the boiler with a heating blower according to the first embodiment of the present invention.

FIG. 2 is a view schematically showing a boiler with a heating blower according to a first embodiment of the present invention and FIG. 3 is a view schematically showing the inside of the boiler with a heating blower according to the first embodiment of the present invention.

Referring to FIGS. 2 and 3, a boiler 50 with a heating blower according to a first embodiment of the present invention includes a housing 100, a burner unit 200, a flue tube 300, and a heating blower 400.

The housing 100 is longitudinally elongated and has an empty internal space, for example, is formed in a cylindrical shape. The housing 100 includes, therein, a storage tub 110 disposed in the longitudinal center empty space, a first space 120 integrally provided on the top of the storage tub 110, a first barrier 122 physically insulating the top of the storage tub 110 and the first space 120; a second space 130 integrally provided under the storage tub 110, and a second barrier 132 physically insulating the bottom of the storage tub 110 and the second space 130. The storage tub 110 is larger in volume than the first and second spaces 120 and 130 to be able to keep as much water as possible. An inlet 112 and an outlet 114 are formed respectively on a first side and a second side between the top and the bottom of the storage tub 110. Cold water flowing in the storage tub 110 through the inlet 112 is heated into hot water through the flue tube 300 and a flame guide tube 210 and the heated hot water is discharged out of the housing 100 through the outlet 114. The inlet 112 and the outlet 114 may be formed in opposite directions, depending on cases.

A discharge unit 140 may be further provided at the second space 130. The discharge unit 140, which is provided for discharging heat such as a flame moving to the second space 130, integrally extends outward from a side of the second space 130. The inside of the discharge unit 140 is a discharge space 140*a* communicating with the second space 130. When a first side of the discharge unit 140 is connected with the second space 130, a discharge hole 142 is formed at a second side of the discharge unit 140, so heat such as a flame moving to the second space 130 is discharged outside through the discharge space 140*a* and the discharge hole 142.

The burner unit 200 includes the flame guide tube 210 elongated longitudinally in the storage tub 110 and a burner 220 disposed on at the lower end of the flame guide tube 210. The flame guide tube 210, for example, is formed in a cylindrical shape having a diameter smaller than the storage tub 110 and a length the same as the storage tub 110. The upper end of the flame guide tube 210 is connected with the first barrier 122 and the lower end of the flame guide tube 210 is connected with the second barrier 132. The upper end of the flame guide tube 210 is connected with the first space 120 through the first barrier 122 and the lower end of the flame guide tube 210 is connected with the second space 130 through the second barrier 132. The burner 220 has a normal structure that generates a flame by burning fuel. The burner 220 is mounted at the lower end of the flame guide tube 210 and generates a flame toward the upper end of the flame guide tube 210 and the first space 120.

The flue tube 300 is composed of a plurality of long tubes and is disposed between the inner surface of the storage tub 110 and the flame guide tube 210. The upper end of the flue tube 300 is connected with the first barrier 122 and the lower end of the flue tube 132 is connected with the second barrier 132. Similar to the flame guide tube 210, the upper end of the flue tube 300 is connected with the first space 120 through the first barrier 122 and the lower end of the flame guide tube 300 is connected with the second space 130 through the second barrier 132. Accordingly, a flame moving to the first space 120 through the flame guide tube 210 moves to the second space 130 through the flue tube 300. In this process, the flue tube 300 is heated to high temperature by the heat of the flame, so the water stored in the storage tub 110 is heated into hot water through heat exchange by coming in contact with the flue tube 300 and the flame guide tube 210.

The heating blower 400 is mounted on the outer surface of the storage tub 110 and blows hot wind into the flame guide tube 210 through the storage tub 110. A plurality of heating blowers may be arranged in parallel longitudinally on both sides of the storage tub 110. When a plurality of heating blowers 400 is mounted on the storage tub 110, high-temperature hot wind can be blown to the flame guide tube 210, so heat exchange efficiency of the flue tube 300 is increased. Further, the heating blower 400 does not occupy a large volume, so there is no need for a large installation space.

Figure 4:
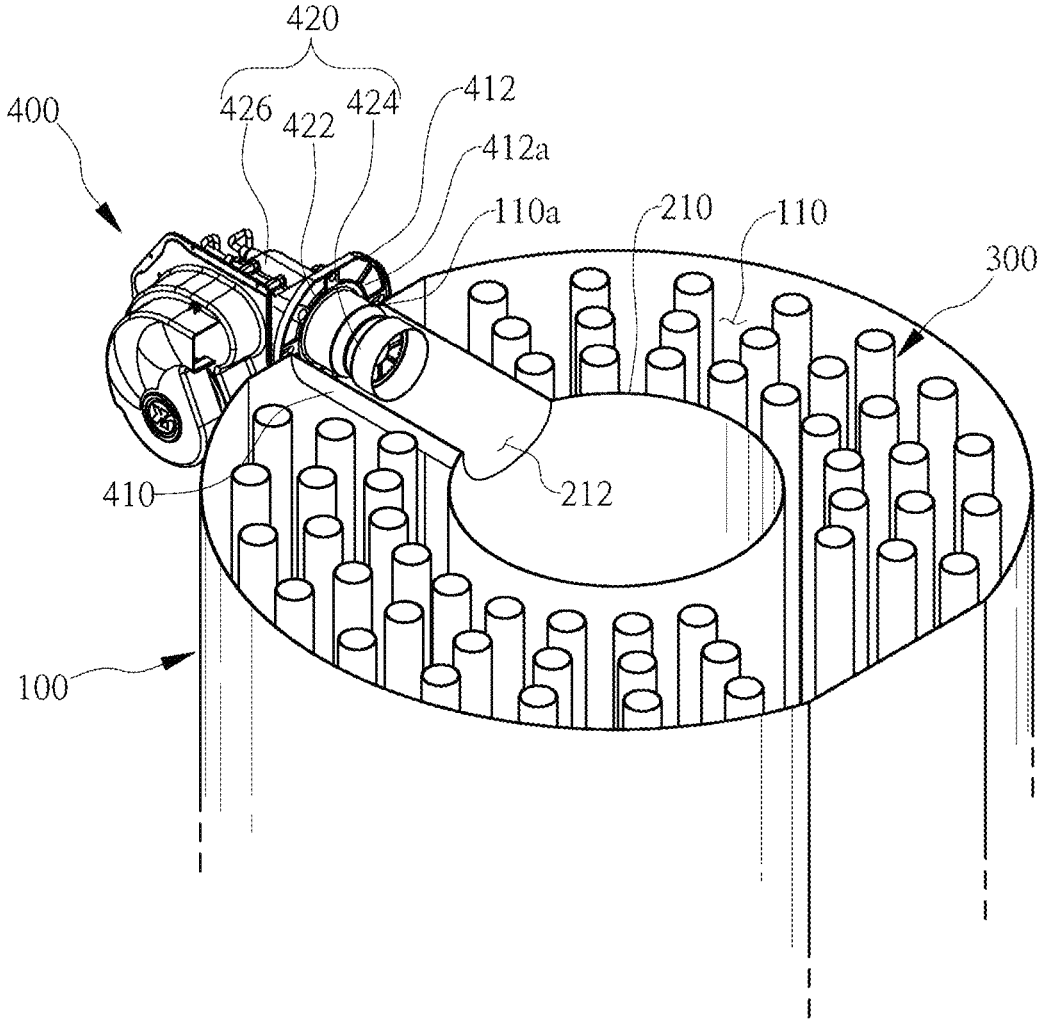
FIG. 4 is a cross-sectional view schematically showing an A-A' cross-section of FIG. 3.
Figure 5:
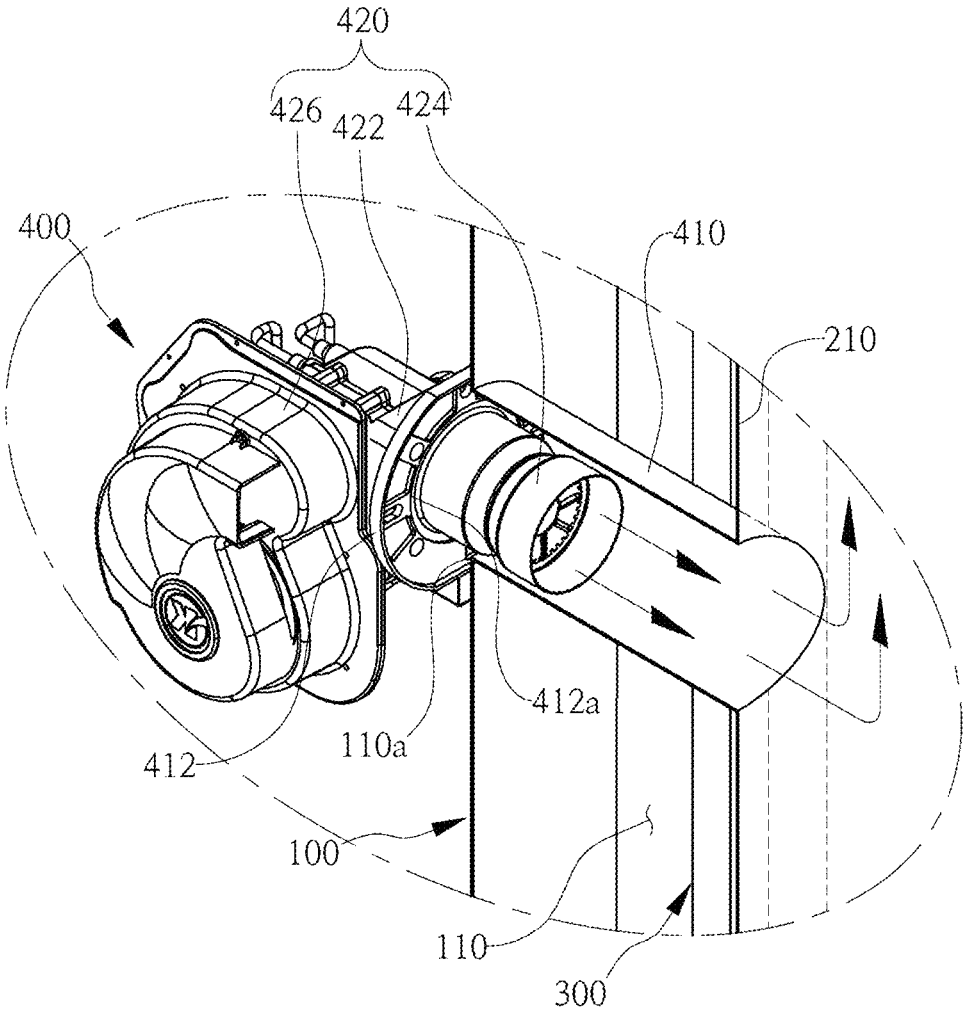
FIG. 5 is a view schematically showing a heating blower of the boiler with a heating blower according to the first embodiment of the present invention.

FIG. 4 is a cross-sectional view schematically showing an A-A' cross-section of FIG. 3 and FIG. 5 is a view schematically showing a heating blower of the boiler with a heating blower according to the first embodiment of the present invention.

Referring to FIGS. 2 to 5, a mounting hole 110*a* is formed through the outer surface of the storage tub 110 to install the heating blower 400 and an intake hole 212 is formed at a position of the flame guide tube 210 which corresponds to the mounting hole 110*a*. The flue tube 300 is disposed between the inner surface of the storage tub 110 and the flame guide tube 210 without overlapping the mounting hole 110*a* and the intake hole 212.

The heating blower 400 includes an external tube 410, an external extension 412, and a heating blower assembly 420. The external pipe 410 is, for example, formed in a cylindrical shape and elongated across the space between the inner surface of the storage tub 110 and the flame guide tube 210 with a first end connected to the mounting hole 110 and a second end connected to the intake hole 211. The external extension 412 covers the first end connected to the mounting hole 110*a* of the external tube 410. A coupling hole is formed through the center of the external extension 412 to couple a coupler 422 to be described below.

The heating blower assembly 420 includes: a coupler 422 coupled to the coupling hole of the external extension 412; a protrusive tube 424 protruding toward the intake hole 213 from a first side of the coupler 422 facing the intake hole 212; and a hot wind supplier 426 mounted on the second side of the coupler 422 opposite the intake hole 212 and supplying hot wind to the protrusive tube 424. The hot wind supplier 426 has a general structure for supplying hot wind, and for example, includes a fan to which air is supplied and a heating coil heating the air into hot wind.

Hot wind generated by the heating blower assembly 420 is supplied to the external tube 410 through the protrusive tube 424 and then moves to the flame guide tube 210 through the intake hole 212 connected to the external tube 410. In this process, since a flame is passing through the flame guide tube 210, the flame and the hot wind are mixed in the flame guide tube 210, so the flame guide tube 210 is increased in temperature more than when only a flame passes through it. Further, the flame and hot wind passing out of the flame guide tube 210 move to the first space 120 and then moves to the flue tube 300. In this process, the flue tube 300 is also increased in temperature more than when only a flame passes through it, similar to the flame guide tube 210.

The water stored in the storage tub 110 primarily exchanges heat with the flame guide tube 210 and the flue tube 300 heated by the flame and secondarily exchanges heat with the flame guide tube 210 and the flue tube 300 heated by the hot wind, whereby heat exchange efficiency is more improved.

Further, since the external tube 410 is disposed in the storage tub 110 to be heated by hot wind, the water stored in the storage tub 110 thirdly exchanges heat with the external tube 410, so the heat exchange efficiency is further improved.

Figure 6A:
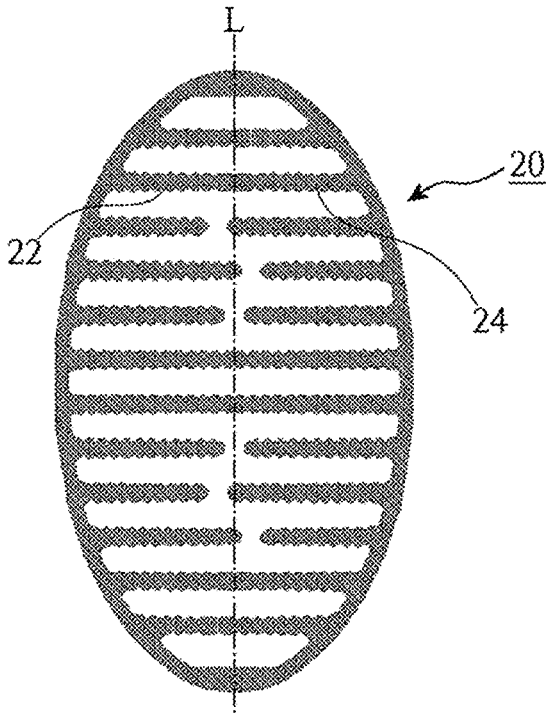
FIGS. 6A and 6B are views showing the inside of a flue tube of a boiler of the related art.
Figure 6B:
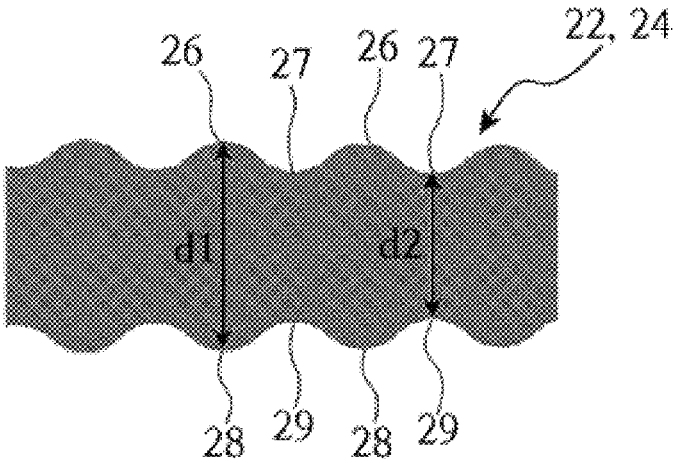
Figure 7A:
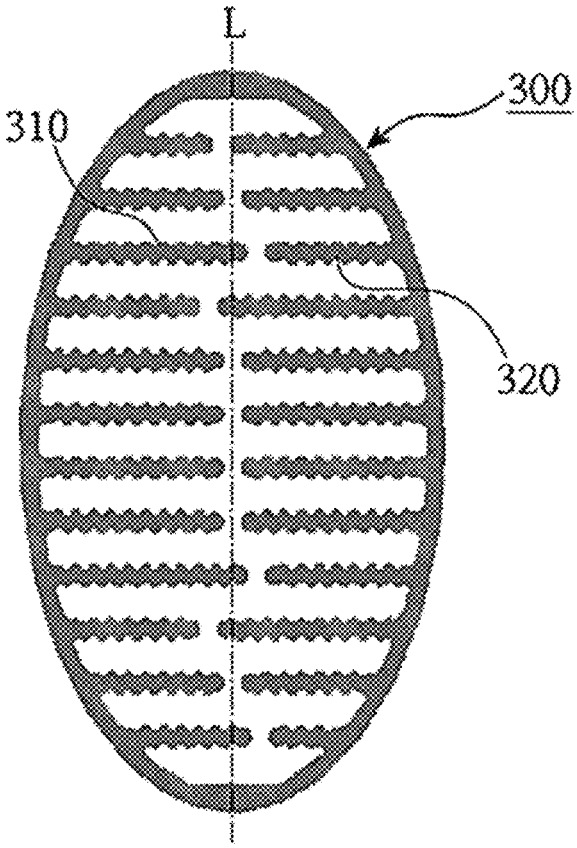
FIGS. 7A and 7B are views schematically showing the inside of a flue tube of the boiler with a heating blower according to the first embodiment of the present invention.
Figure 7B:
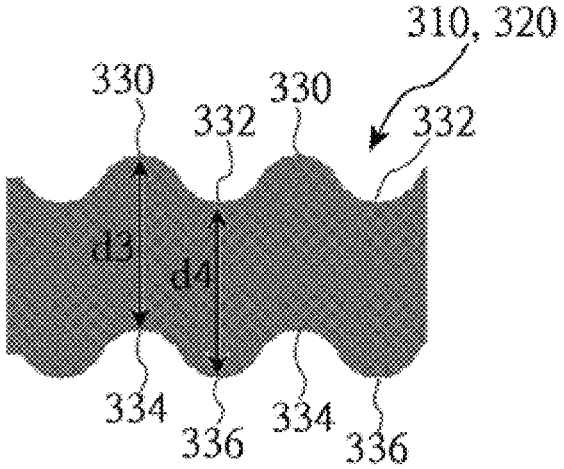

FIGS. 6A and 6B are views showing the inside of a flue tube of a boiler of the related art and FIGS. 7A and 7B are views schematically showing the inside of a flue tube of the boiler with a heating blower according to the first embodiment of the present invention.

First, referring to FIGS. 6A and 6B, a plurality of first fins 22 and second fins 24 are provided longitudinally in a flue tube 20 of the related art. The first fins 22 protrude perpendicular to an imaginary center line L passing through the center of the inner surface of the flue tube 20 on a first side of the inner surface of the flue tube 20 from the center line L, and the second fins 24 protrude perpendicular to the center line L on a second side of the inner surface of the flue tube 20. A flame moving through the flue tube 20 increases in contact area by coming in contact with the first and second fins 22 and 24, so the first and second fins 22 and 24 are heated and the heated first and second fins 22 and 24 heat the flue tube 20, whereby the flue tube 20 is heated more.

A plurality of first convex portions 26 and first concave portions 27 are alternately arranged on longitudinal first sides of the first fins 22 and the second fins 24. A plurality of second convex portions 28 and second concave portions 29 are alternately arranged on longitudinal second sides of the first fins 22 and the second fins 24. The first convex portions 26 and the second convex portions 28 are arranged to face each other, and the first concave portions 27 and the second concave portions 29 are arranged to face each other, so the width d1 between the first convex portions 26 and the second convex portions 28 is larger than the width d2 between the first concave portions 27 and the second concave portions 29. However, a heat transfer rate is in inverse proportion to a heat conductive thickness. Accordingly, since the first width d1 between the first convex portions 26 and the second convex portions 28 is larger than the second width d2 between the first concave portions 27 and the second concave portions 29, the heat transfer rate of the first and second convex portions 26 and 28 is lower than that of the first and second concave portions 27 and 29.

Further, some of the first and second fins 22 and 24 are connected to each other and the connected first and second fins 22 and 24 block the flame moving through the flue tube 20, thereby limiting movement of the flame.

Next, referring to FIGS. 7A and 7B, a plurality of first heat exchange fins 310 and second heat exchange fins 320 are protruded and arranged in the longitudinal direction of a flue tube 300 in the flue tube 300 of the present invention. The first heat exchange fins 310 protrude perpendicular to an imaginary center line L passing through the center of the inner surface of the flue tube 300 on a first side of the inner surface of the flue tube 300 from the center line L, and the second heat exchange fins 320 protrude perpendicular to the center line L on a second side of the inner surface of the flue tube 300. A flame and hot wind moving through the flue tube 300 increase in contact area by coming in contact with the first and second heat exchange fins 310 and 320, so the first and second heat exchange fins 310 and 320 are heated and the heated first and second heat exchange fins 310 and 320 heat the flue tube 300, whereby the flue tube 300 is heated more.

A plurality of first convex portions 330 and first concave portions 332 are alternately arranged on longitudinal first sides of the first heat exchange fins 310 and the second heat exchange fins 320. A plurality of second convex portions 336 and second concave portions 334 are alternately arranged on longitudinal second sides of the first heat exchange fins 310 and the second heat exchange fins 320. The first convex portions 330 and the second concave portions 334 are arranged to face each other, and the first concave portions 332 and the second convex portions 336 are arranged to face each other, so a third width d3 between the first convex portions 330 and the second concave portions 334 is larger than a fourth width d4 between the first concave portions 332 and the second convex portions 336. As described above, since the first convex portions 330 and the second convex portions 336 do not face each other, the third width and the fourth width are the same, so the first and second heat exchange fins 310 and 320 are formed thinly with a generally constant width. Accordingly, the heat transfer rate of the first and second heat exchange fins 310 and 320 is kept constant, so the heat exchange efficiency of the first and second heat exchange fins 310 and 320 is improved.

Further, the first heat exchange fins 310 and the second heat exchange fins 320 that face each other are spaced apart from each other and a pair of adjacent first heat exchange fins 310 are the same or different in length, so a flame and hot water passing through the flue tube 300 pass through between the first and second heat exchange fins 310 and 320 without being blocked. Accordingly, the flame and hot wind can easily move, so the heat exchange efficiency is improved.

Figure 8:
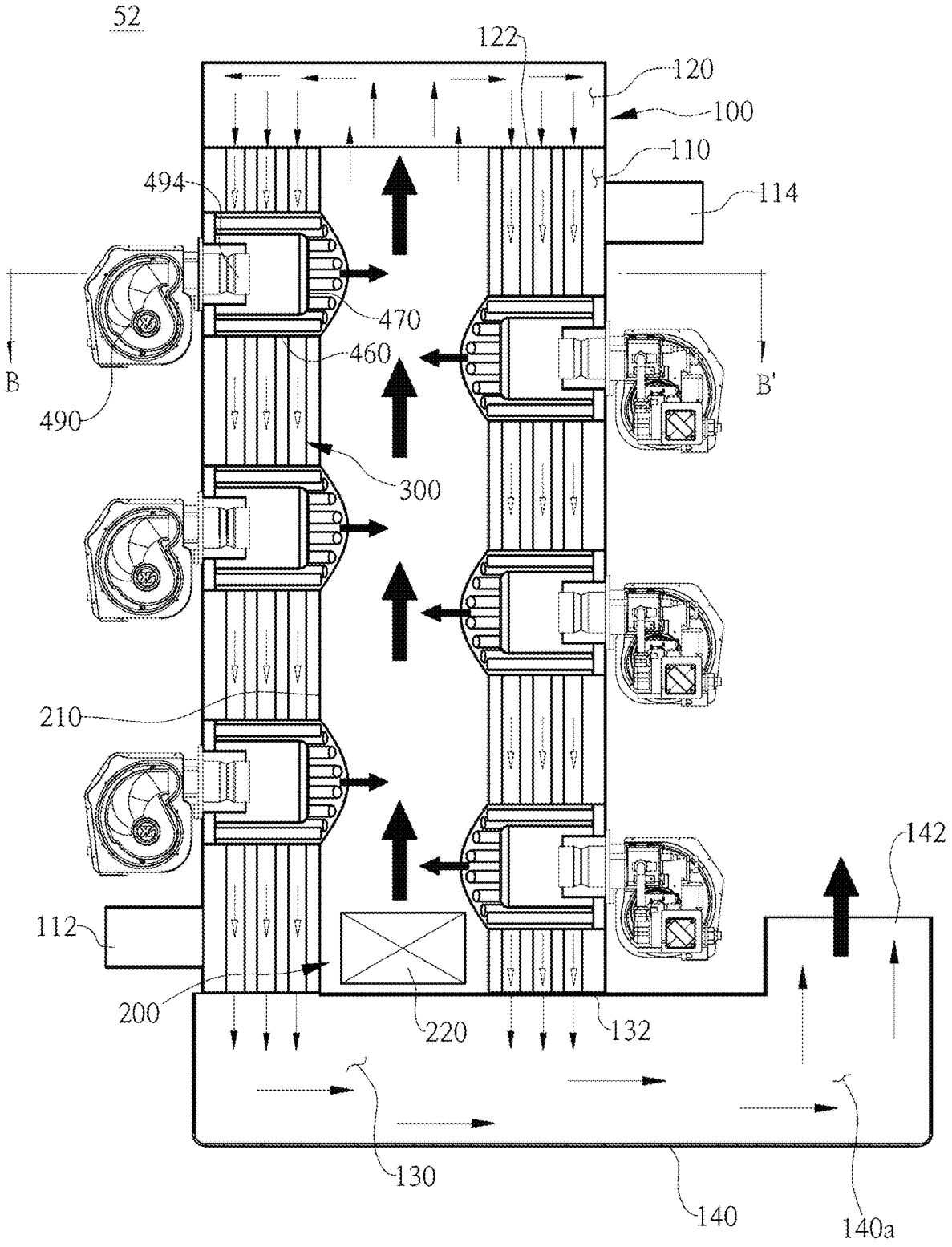
FIG. 8 is a view schematically showing the inside of a boiler with a heating blower according to a second embodiment of the present invention.
Figure 9:
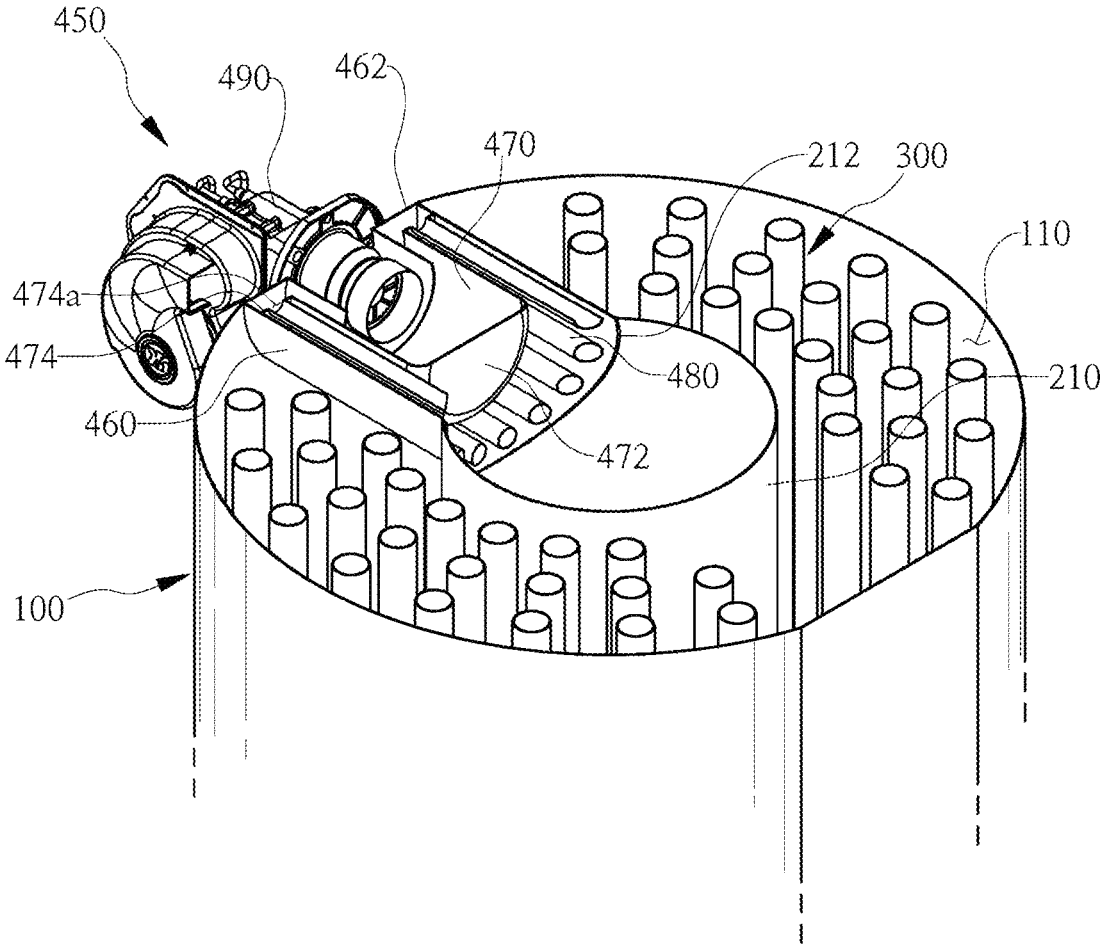
FIG. 9 is a cross-sectional view schematically showing an B-B' cross-section of FIG. 8.

FIG. 8 is a view schematically showing the inside of a boiler with a heating blower according to a second embodiment of the present invention, FIG. 9 is a cross-sectional view schematically showing an B-B' cross-section of FIG. 8, and FIG. is a view schematically showing a heating blower of the boiler with a heating blower according to the second embodiment of the present invention.

Figure 10:
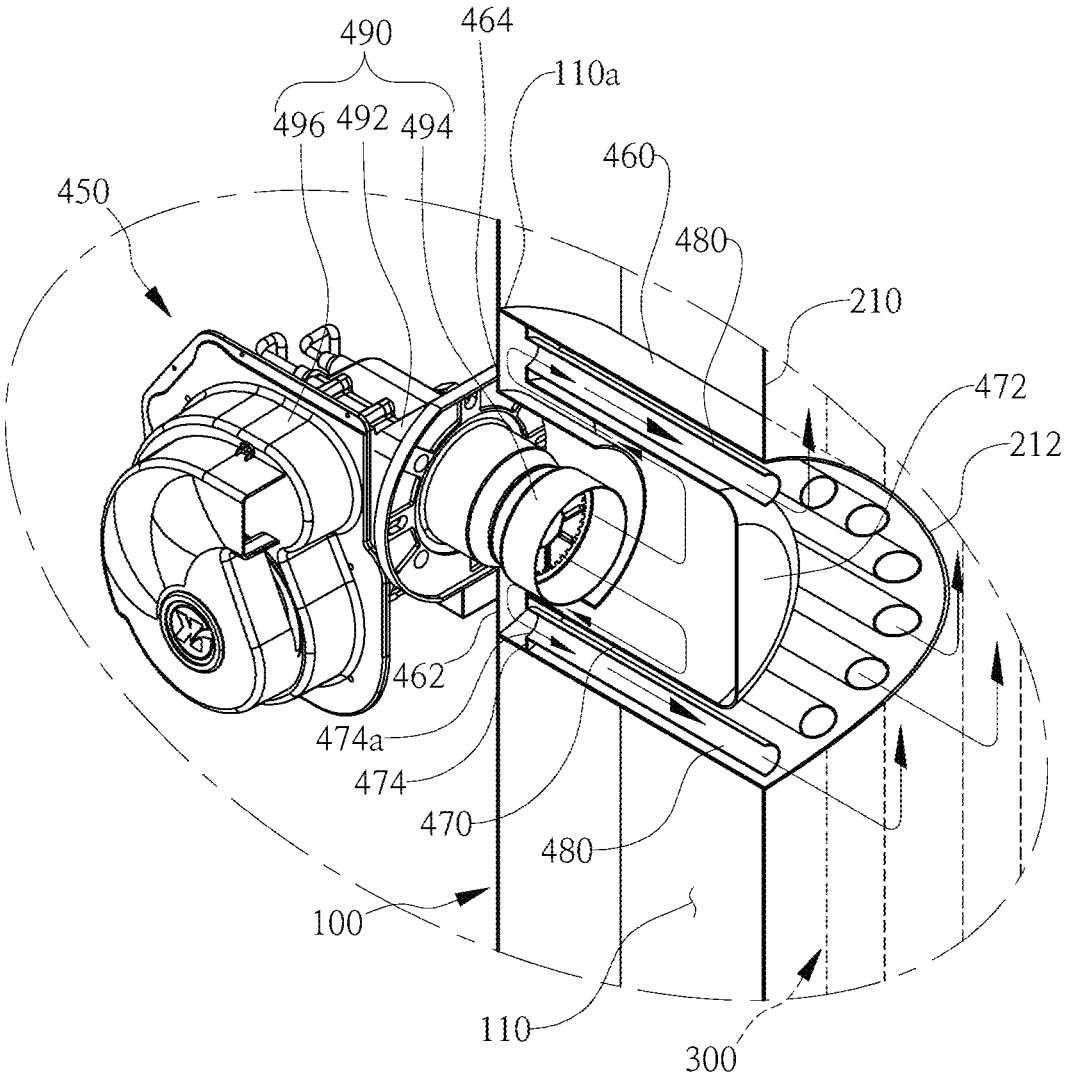
FIG. 10 is a view schematically showing a heating blower of the boiler with a heating blower according to the second embodiment of the present invention.

Referring to FIGS. 8 to 10, a boiler 52 with a heating blower according to a second embodiment of the present invention has the same configuration as the first embodiment except for having a heating blower 450 that is different from that of the first embodiment. That is, the boiler 52 with the heating blower 450 according to the second embodiment of the present invention includes a housing 100, a burner unit 200, a flue tube 300, and a heating blower 450.

The heating blower 450 includes an external tube 460, an external extension 462, an internal tube 470, a dead-end 472, an internal extension 474, heat tubes 480, and a heating blower assembly 490. The external pipe 460, for example, is formed in a cylindrical shape with a first end connected to the mounting hole 110*a* and a second end connected to the intake hole 212. The external extension 462 covers the first end connected to the mounting hole 110*a* of the external tube 460. A coupling hole 464 is formed at the center of the external extension 462 facing the internal tube 470 to be described below to couple a coupler 492 of the heating blower assembly 490.

The internal tube 470, for example, is formed in a cylindrical shape with a diameter smaller than the external tube 460. The internal tube 470 is smaller in length than the external tube 460, so the internal tube 470 is accommodated in the external tube 460. The dead-end 472 closes a first end, which faces the flame guide tube 210, of the internal tube 470. The internal extension 474 extends along the outer surface of a second end of the internal tube 470 spaced apart from the external extension 462 to be connected to the inner surface of the external tube 460. A plurality of through-holes 474*a* is formed at a side of the internal extension 474 to connect heat pipes 480 to be described below around the internal extension 474.

The heat tubes 480 are formed in cylindrical shapes and arranged in parallel between the internal tube 470 and the external tube 460. The heat tubes 480 have first ends connected to the through-holes 474*a* and second ends extending toward the intake hole 212. The heating blower assembly 490 includes: a coupler 492 coupled to the coupling hole 464 of the external extension 462; a protrusive tube 494 protruding toward the internal tube 470 from a first side of the coupler 492 facing the internal tube 470; and a hot wind supplier 496 mounted on the second side of the coupler 492 opposite the internal tube 470 and supplying hot wind to the protrusive tube 494.

The hot wind discharged toward the internal tube 470 from the heating blower assembly 490 primarily turns toward the external extension 462 after hitting against the dead-end 472, secondarily turns toward the heat tubes 480 after hitting against the external extension 462, and then flows into the flame guide tube 210 through the heat tubes 480 and the intake hole 212. As described above, since the hot air discharged from the heating blower assembly 490 turns twice and then flows into the flame guide tube 210, the hot water remain longer in the internal tube 470 and the external tube 460 and comes in contact with the internal tube 470 and the external tube 460 in more areas, so the internal tube 470 and the external tube 460 are heated more by the hot air. Therefore, the water stored in the storage tub 110 and coming in direct contact with the external tube 460 exchanges more heat with the external tube 460, so the entire heat exchange rate is improved.

Although the present invention was described above with reference to the embodiment, the present invention is not limited to the embodiment and it is apparent to those skilled in the art that the present invention may be changed and modified in various ways within the scope of the present invention. Further, the changes and modifications should be construed as being included in the present invention if they belong to the claims.

The invention claimed is:

1. A boiler with a heating blower, comprising:

a housing including a storage tub storing water therein, a first space formed at a first end of the storage tub, a first barrier insulating the storage tub and the first space, a second space formed at a second end of the storage tub, a second barrier insulating the storage tub and the second space, and an inlet and an outlet formed on both sides of the storage tub;

a burner unit including a flame guide tube elongated in the storage tub, with a first end connected with the first space through the first barrier and a second end connected with the second space through the second battier, and a burner disposed in the flame guide tube;

a plurality of flue tubes disposed between an inner surface of the storage tub and the flame guide tube, with an end connected with the first space through the first barrier and a second end connected with the second space through the second barrier; and a heating blower having a first end mounted on the storage tub and a second end passing through the storage tub, and generating hot wind toward the flame guide tube, wherein a flame generated by the burner moves toward the first end of the flame tube and is then supplied to the flue tubes through the first space, and hot wind generated by the heating blower moves to the flame guide tube and is then supplied to the flue tubes through the first space.

2. The boiler of claim 1, wherein a plurality of heating blowers is arranged in parallel in a longitudinal direction of the storage tub.

3. The boiler of claim 1, wherein a mounting hole is formed through an outer surface of the storage tub and an intake hole is formed at a position of the flame guide tube which corresponds to the mounting hole, the flue tubes are disposed between the inner surface of the storage tub and the flame guide tube without overlapping the mounting hole and the intake hole, and the heating blower includes:

an external tube connecting the mounting hole and the intake hole to each other;

an external extension covering an end connected with the mounting hole of the external tube; and a heating blower assembly generating hot wind to the external tube through the external extension.

4. The boiler of claim 1, wherein a mounting hole is formed through an outer surface of the storage tub and an intake hole is formed at a position of the flame guide tube which corresponds to the mounting hole, the flue tubes are disposed between the storage tub and the flame guide tube without overlapping the mounting hole and the intake hole, and the heating blower includes:

an external tube connecting the mounting hole and the intake hole to each other;

an external extension covering an end connected with the mounting hole of the external tube;

an internal tube having a diameter smaller than the external tube and accommodated in the external tube;

a dead-end closing a first end, which faces the flame guide tube, of the internal tube; and a heating blower assembly generating hot wind to the internal tube through the external extension.

5. The boiler of claim 4, further comprising:

an internal extension extending along an outer surface of a second end of the internal tube spaced apart from the external extension to be connected to an inner surface of the external tube, and having a plurality of through-holes; and heat tubes extending respectively in the through-holes toward the intake hole, wherein hot air discharged toward the internal tube from the heating blower assembly primarily turns toward the external extension after hitting against the dead-end, secondarily turns toward the heat tubes after hitting against the external extension, and then flows into the flame guide tube through the heat tubes and the intake hole.

6. The boiler of claim 4, wherein the heating blower assembly includes:

a coupler coupled to a coupling hole formed in the external extension to face the internal tube;

a protrusive tube protruding toward the internal tube from a first side facing the internal tube of the coupler; and a hot wind supplier supplying hot wind from a second side of the coupler to the protrusive tube.

7. The boiler of claim 1, comprising first heat exchange fins protruding perpendicular to an imaginary center line passing through a center of an inner surface of the flue tube on a first side of the inner surface of the flue tube from the center line, and second heat exchange fins protruding perpendicular to the center line on a second side of the inner surface of the flue tube to face the first heat exchange fins, wherein a plurality of first convex portions and first concave portions are alternately arranged on longitudinal first sides of the first heat exchange fins and the second heat exchange fins and a plurality of second convex portions and second concave portions are alternately arranged on longitudinal second sides of the first heat exchange fins and the second heat exchange fins such that the first convex portions and the second concave portions are arranged to face each other and the first concave portions and the second convex portions are arranged to face each other, and a gap between the first convex portions and the second concave portions and a gap between the first concave portions and the second convex portions are the same.

8. The boiler of claim 7, wherein the first heat exchange fins and the second heat exchange fins that face each other are spaced apart from each other, and a pair of adjacent first heat exchange fins are the same or different in length.

* * * * *